US006985112B2

(12) United States Patent
Sadamori et al.

(10) Patent No.: US 6,985,112 B2
(45) Date of Patent: Jan. 10, 2006

(54) ANTENNA

(75) Inventors: Hideto Sadamori, Okayama (JP); Yoshinobu Nakagawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 70 days.

(21) Appl. No.: 10/822,694

(22) Filed: Apr. 13, 2004

(65) Prior Publication Data

US 2004/0252063 A1 Dec. 16, 2004

(30) Foreign Application Priority Data

Jun. 11, 2003 (JP) ..... 2003-166165

(51) Int. Cl.
*H01Q 1/24* (2006.01)

(52) U.S. Cl. ..... 343/702; 343/895; 343/700 MS

(58) Field of Classification Search ..... 343/702, 343/700 MS, 895, 846, 848, 906; H01Q 1/24
See application file for complete search history.

(56) References Cited

U.S. PATENT DOCUMENTS 6,707,427 B2 * 3/2004 Konishi et al. ..... 343/700 MS
6,720,924 B2 * 4/2004 Tomomatsu et al. . 343/700 MS

FOREIGN PATENT DOCUMENTS

| | | |
|---|---|---|
| EP | 000944128 A1 * | 9/1999 |
| JP | 10-13287 | 1/1998 |
| JP | 11-163613 | 6/1999 |

* cited by examiner

*Primary Examiner*—Hoanganh Le

(74) *Attorney, Agent, or Firm*—McDermott Will & Emery LLP

(57) ABSTRACT

An antenna providing easy and effective mounting procedures onto a wireless device for mobile communications and highly reliable electrical connections. The antenna contains insulating resin-made core 11 that is generally formed into a rectangular parallelepiped, and metallic thin-plate antenna element 12 from which feeding terminal 12A and joint sections 12C are extended. Antenna element 12 is disposed on top surface 11F, side surface 11B, and bottom surface 11G of core 11. Antenna element 12 is then fixed to core 11 by caulking at caulking projections 11A formed on the top surface of core 11. Feeding terminal 12A is bent to have L-shaped tip 12B on side surface 11D; similarly, joint sections 12C are bent to have L-shaped tips 12D on side surfaces 11C and 11E. These tips are bent at the same level according to the thickness of a wiring board to be soldered.

6 Claims, 9 Drawing Sheets

ANTENNA

FIELD OF THE INVENTION

The present invention relates to an antenna used for a wireless device for mobile communications such as a handy telephone.

BACKGROUND ART

Recently, wireless devices for mobile communications including a handy telephone have been getting smaller and more multi-functional. Accordingly, as an antenna to be mounted on such a compact device, a built-in type has become popular.

Here will be described a conventional built-in type antenna with reference to FIG. 10 and FIG. 11. FIG. 10 is a perspective view showing the appearance of a conventional antenna. Insulating resin-made core 1 has body 1A generally shaped into a rectangular parallelepiped. Three projections 1C, which project from each periphery of three corners of body 1A, are disposed in parallel with each other. Each of projections 1C has hole 1B therein.

Antenna element 2, which is made of a metallic thin plate, is calked on the upper side of core 1 with projections 1D disposed on the upper surface of body 1A of core 1.

Antenna element 2 contains feeding terminal 2A. Feeding terminal 2A projects in a slanting-down direction from a periphery of the corner having no projection 1C of core 1. Conventional antenna 3 is structured above.

FIG. 11 shows how antenna 3 is mounted on a wireless device—specifically, shows the state previous to be accommodated in case 4 of a wireless device for mobile communications.

Antenna 3 is placed in a space adjacent to wiring board 5 in case 4, using three wood screws 6 each of which is through hole 1B of projection 1C and boss 4A of case 4 corresponding to each projection 1C.

Wiring board 5 includes communications circuit 5B located in area 5C shown by the dash lines in FIG. 11. The explanation of the components (not shown) of circuit 5B is omitted. When antenna 3 is fixed in case 4, the tip of feeding terminal 2A integrally formed with antenna element 2 has a tight contact with feeding section 5A (which is further connected with communications circuit 5B) of wiring board 5. With the structure, an operation performed by circuit 5B establishes wireless communications via antenna 3.

References relating to the prior-art technology described above are introduced in, for example, Japanese Patent Non-examined Publications No. H11-163613 and H10-13287.

A prior art antenna, as described above, is mounted on a wireless device by wood screws 6, which inconveniently decreases mounting efficiencies and increases production costs. Furthermore, due to the structure in which feeding terminal 2A makes a tight contact with feeding section 5A of wiring board 5, the prior-art antenna cannot ensure stability in electrical connections when an impact load is applied thereto. It has been a pending problem to be improved.

SUMMARY OF THE INVENTION

The present invention addresses the problem above. It is therefore the object of the present invention to provide an antenna that offers not only an easy mounting on a wireless device, but also higher reliability in electrical connections.

To achieve the object above, the antenna of the invention is formed of i) a rod-like core made of insulating resin, and ii) an antenna element containing a feeding terminal secured to the core. Such structured antenna is mounted on a wireless device in such a way that the core is fitted in a notch formed in a wiring board of the wireless device and then the feeding terminal is soldered onto the wiring board of the device. Fitting the core into the notch of the wiring board allows the antenna to be properly positioned with respect to the wiring board. Besides, the feeding terminal can be soldered, as well as other components, in the same step. This contributes to decreased manufacturing cost. Furthermore, such mounted antenna can maintain secure connections with the wiring board of the wireless device, thereby ensuring electrical connections with reliability and mechanical strength against impact load from the outside.

It is another aspect of the present invention that i) the core is generally shaped into a rectangular parallelepiped, and ii) a joint section for soldering is disposed on side surfaces of the core other than the side surface on which the feeding terminal of the antenna element is provided. The core can be easily manufactured because of its simple shape. In addition, the antenna is soldered, through two or more positions on the side surfaces of the core, to the wiring board. This can provide a further steady mounting, which is resistant to impact load from the outside.

It is still another aspect of the present invention that the feeding terminal and the joint section are located substantially at the midpoint of a side surface of the core in the height direction. That is, the antenna is soldered to the wiring board of a wireless device so that the thickness of the core is evenly divided on the upper side and the lower side of the wiring board. Such a positioning provides, for example, spaces on the lower side of the wiring board for an effective use. In other words, the structure increases dimensional flexibility in the thickness direction of the wireless device.

It is yet another aspect of the present invention that the core is force-fitted into the notch of the wiring board. With the structure, the antenna can be retained in a stable condition, although in temporary assembly until the core is soldered onto the wiring board, without worry about being come off the wiring board. The structure provides an easy handling of the wiring board during transportation.

It is another aspect of the present invention that the core of the antenna contains projections that downwardly extend under the wiring board on which the antenna is mounted. Fixing the projections to the wiring board by calking allows the antenna to be retained in temporary assembly until the core is soldered onto the wiring board. Therefore, the efficiency of mounting procedures is improved.

It is still another aspect of the present invention that the core contains a pedestal under the side surface on which the feeding terminal is disposed, and the gap between the tip of the feeding terminal and the principle plane of the pedestal is determined so as to be slightly smaller than the thickness of the wiring board. With the wiring board being clipped between the tip of the feeding terminal and the pedestal, the antenna can keep the right position until the core is soldered to the wiring board. If the wiring board with the antenna in temporary assembly (before soldering) had to be transported, the structure would minimize inconveniencies, for example, coming-off or being out of the right position.

DETAILED DESCRIPTION OF THE INVENTION

An embodiment of the present invention is described hereinafter with reference to the accompanying drawings, FIG. 1 through FIG. 8.

Exemplary Embodiment

Figure 1:
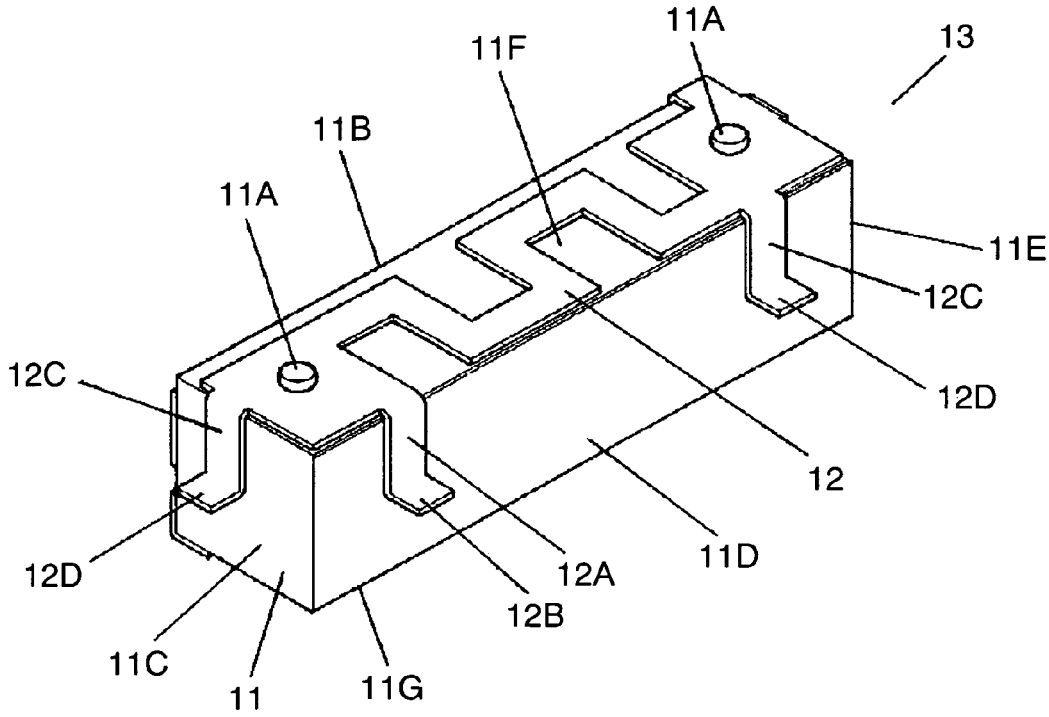
FIG. 1 is a perspective view showing the appearance of an antenna in accordance with an embodiment of the present invention.
Figure 2:
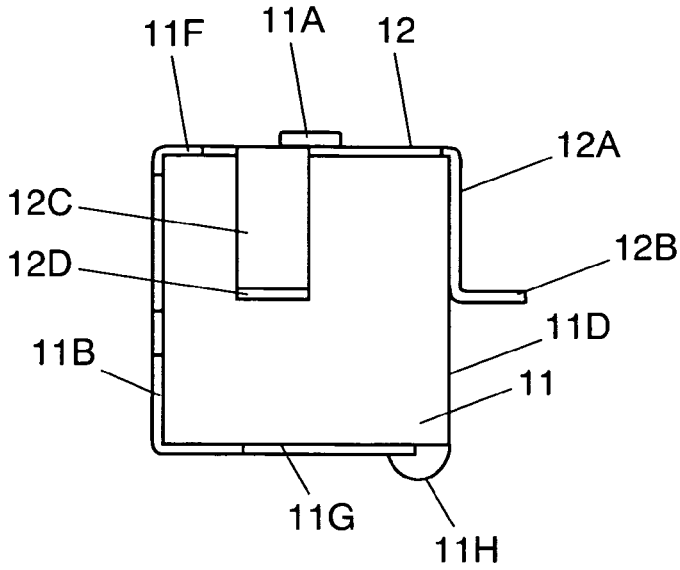
FIG. 2 is a side view of the antenna shown in FIG. 1.

FIG. 1 is a perspective view showing the appearance of an antenna in accordance with an embodiment of the present invention, and FIG. 2 is a side view of the antenna shown in FIG. 1. Insulating resin-made core 11, which is generally formed into a rectangular parallelepiped, contains two caulking projections 11A on upper surface 11F.

Antenna element 12, which is a metallic thin plate, is formed into U shape in section through blanking and bending processes.

Antenna element 12 is disposed on core 11 in such a way that the U shape conforms to top surface 11F, side surface 11B, and bottom surface 11G, and then secured to core 11 by caulking at caulking projections 11A on top surface 11F and a caulking projection (not shown) disposed at the edge of bottom surface 11G.

Antenna element 12 contains an element section on lengthwise side surface 11B of core 11, top surface 11F, and bottom surface 11G.

The element section of antenna element 12 on top surface 11F of core 11 contains L-shaped feeding terminal 12A. Climbing down along lengthwise side surface 11D toward bottom surface 11G, feeding terminal 12A is bent substantially at the midpoint of height H0 of side surface 11D (i.e., H0/2) to form tip 12B.

Antenna element 12 also contains L-shaped joint sections 12C, each of which downwardly extends along side surfaces 11D, 11C, 11E, respectively, toward bottom surface 11G. Like feeding element 12A, each of joint sections 12C is bent at the same level of tip 12B of feeding terminal 12A—approximately at H0/2—to form tip 12D of the L shape.

FIG. 2 shows the state in which antenna element 12 is attached to core 11. FIG. 2 is a side view of the same structure shown in FIG. 1, detail explanations on the components will therefore be omitted. As described above, tip 12B of feeding terminal 12A and tips 12D of joint sections 12C are bent substantially at the midpoint of height H0 of side surface 11D (i.e., H0/2) to form the L shape.

Figure 3:
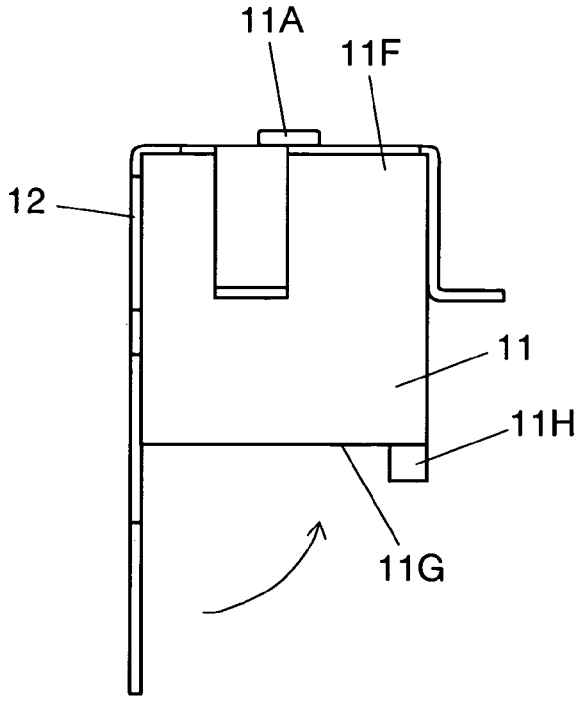
FIG. 3 is a side view depicting how the antenna element is disposed.

FIG. 3 shows the state in which the upper section of antenna element 12 is fixed by caulking. That is, after temporarily fixed to core 11, antenna element 12 is bent into an L shape, and caulking holes of antenna element 12 fit onto caulking projections 11A disposed on top surface 11F of core 11. Projections 11A are then crashed to complete caulking. To reach the state shown in FIG. 2, steps to be followed are: bending lower section 12E of antenna element 12 in the direction of arrow 11J, i.e., to bottom surface 11G; caulking the end of lower section 12E by crashing projection 11H formed at the edge of bottom surface 11G. Lower section 12E is thus secured to core 11.

Now will be described the mounting process of such structured antenna 13 onto, for example, a wireless device for mobile communications with reference to the drawings.

Figure 4:
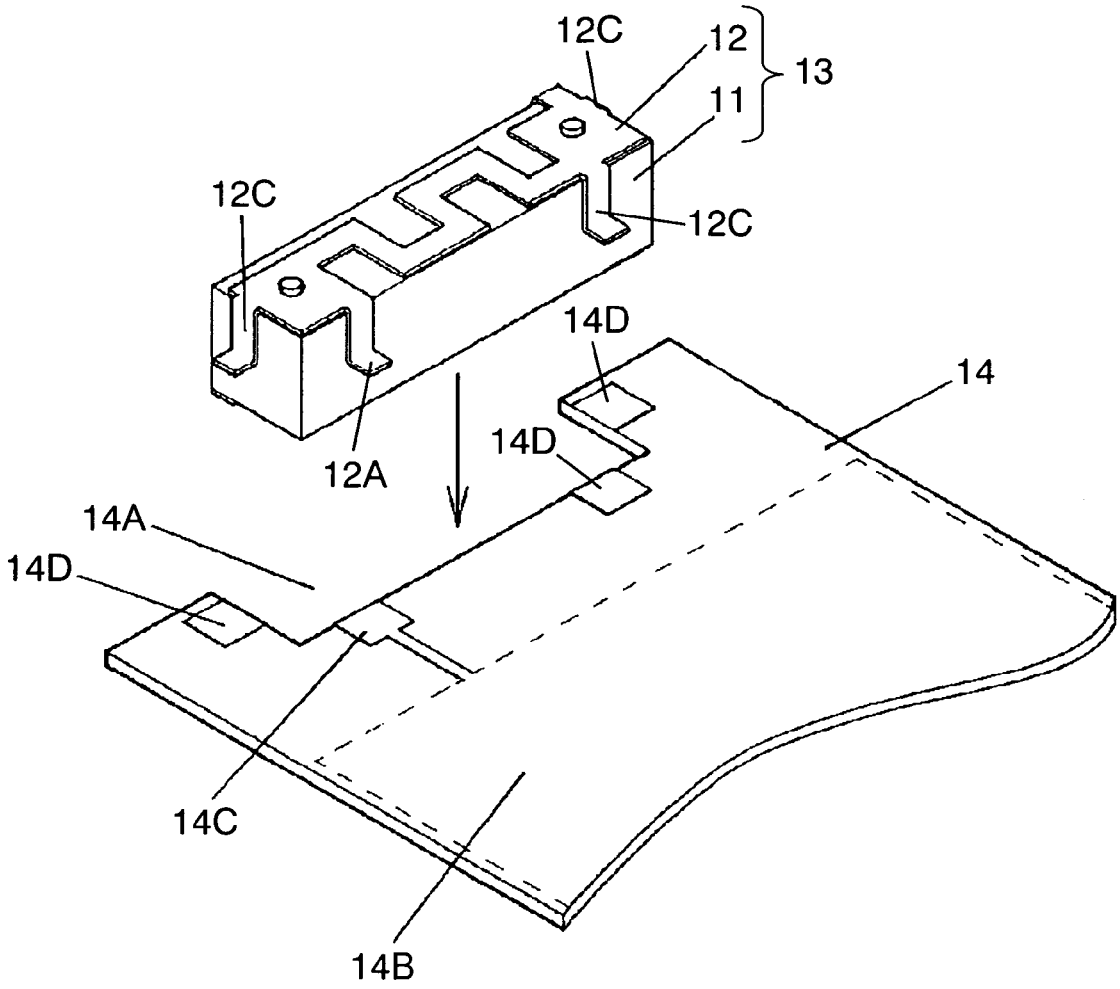
FIG. 4 is a perspective view illustrating how to mount the antenna on a wiring board of a wireless device.

FIG. 4 is a perspective view illustrating how to mount the antenna on a wiring board of a wireless device (not shown). Wiring board 14 of FIG. 4 contains notch 14A so as to conform the rectangular side of core 11.

Like a wiring board employed for the prior-art structure, wiring board 14 contains communications circuit 14B in area 5C (indicated by the dash lines). The explanation of the components (not shown) of circuit 14B is omitted.

For feeding power to antenna 13, feeder 14C extends from communications circuit 14B to notch 14A. In addition, fixed lands 14D are disposed at positions corresponding to each joint section 12C of antenna 13. Fixed lands 14D can be soldered, and electrically independent with each other.

To mount antenna 13 on wiring board 14, firstly, core 11 of antenna 13 is fitted into notch 14 so that feeding terminal 12A meets with feeder 14C, and three joint sections 12C meet with corresponding fixed lands 14D.

Figure 5:
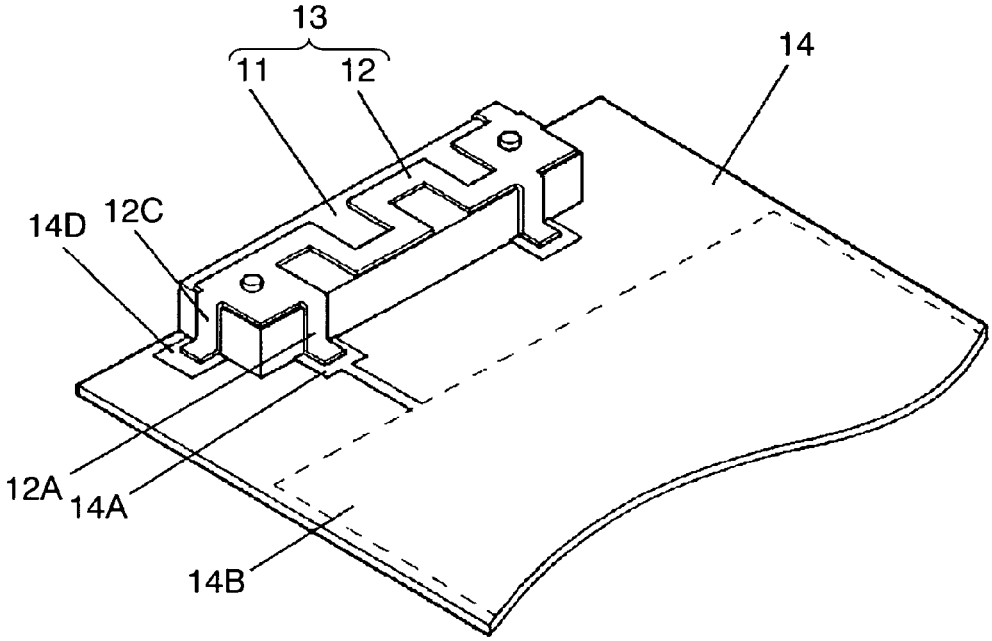
FIG. 5 is a perspective view illustrating the antenna mounted on the wiring board of the wireless device.

FIG. 5 shows antenna 13 mounted on wiring board 14, as well as other components (not shown), by dip soldering or reflow soldering. Antenna 13 is thus securely mounted onto wiring board 14.

According to the embodiment, core 11 of antenna 13 is generally shaped into a rectangular parallelepiped. By virtue of the simple shape, core 11 can be manufactured with ease. Similarly, notch 14A of wiring board 14 for accepting antenna 13 is shaped relatively simple. The simple structure contributes to an easy processing and minimized space between antenna 13 and notch 14A.

In the structure of the embodiment, side surface 11D of core 11 contains feeding terminal 12A, while side surface 11C and side surface 11E opposite to surface 11C contain each joint section 12C. That is, with the three joint sections disposed on the surfaces of core 11, antenna 13 can be held in a stable condition, although in temporary assembly until being soldered. Therefore, if wiring board 14 with antenna 13 before soldering had to be transported, the structure would minimize inconveniencies, for example, coming-off or being out of the right position.

As described above, core 11 has a snug fit with notch 14A. After soldering, antenna 13 is securely mounted on wiring board 14 through feeding terminal 12A of antenna element 12 and joint sections 12C disposed on side surfaces 11C and 11D, whereby a firm attachment is obtained. If a perceptible impact load is applied to the wireless device caused by an accidental fall, electrical connections between antenna element 12 and communications circuit 14B can be maintained with stability.

Figure 6:
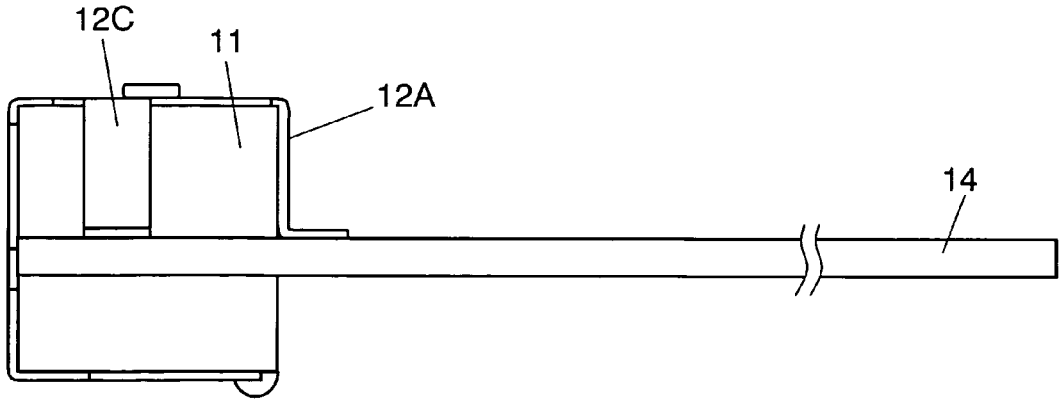
FIG. 6 is a side view illustrating the antenna mounted on the wiring board of the wireless device.

FIG. 6 is a side view illustrating antenna 13 mounted on wiring board 14. As shown in the figure, tip 12B of feeding terminal 12 and each of tips 12D of joint sections 12C are located substantially at the midpoint of height H0 of core 11 in the height direction. In other words, the thickness of core 11 is evenly divided, through wiring board 14, in the upwardly stand-out portion (H1) and the downwardly stand-out portion (H2). Such a positioning provides space 14S for an effective use on the lower side of wiring board 14. At the same time, the structure increases dimensional flexibility in the thickness direction of the wireless device.

To set the antenna to desirable frequency bands, the position of feeding terminal 12A electrically connected to circuit 14B of wiring board 14 can be replaced with any one of positions of joint sections 12C. Such positional setting can be determined according to the size or shape of communications circuit 14B mounted of wiring board 14. The structure with design flexibility is an advantage of the present invention.

Figure 7:
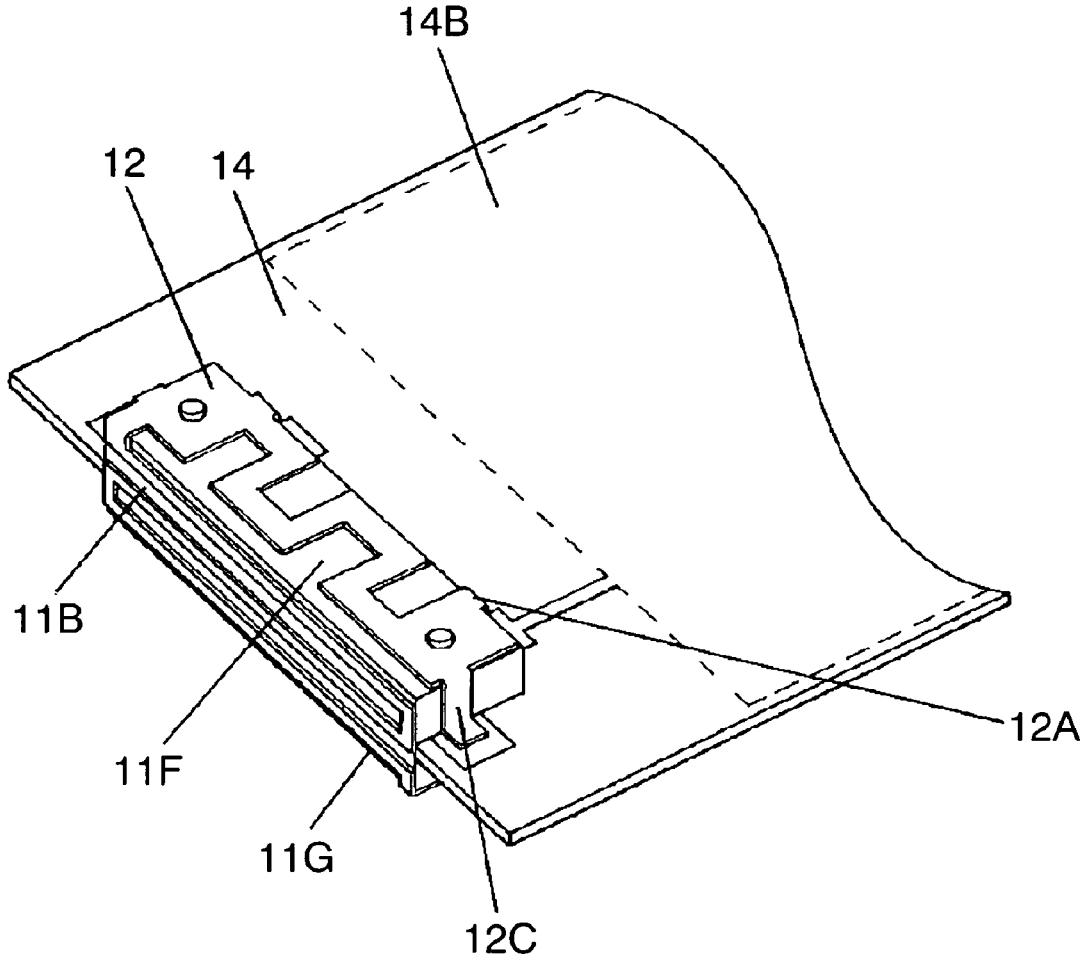
FIG. 7 is a perspective view illustrating the antenna mounted on the wiring board of the wireless device.

FIG. 7 is a perspective view illustrating the antenna mounted on the wiring board of the wireless device. The element section of antenna element 12 is positioned on top surface 11F, bottom surface 11G, and lengthwise side surface 11B—the surface most distant from circuit 14B—of core 11. The height of antenna 12 from the upper surface of wiring board 14 (indicated by H1 in FIG. 6) measures approximately one half of H0 —the whole height of antenna element 12. Antenna 13 contains the other half the thickness on the lower surface of wiring board 14. The structure provides good antenna characteristics without degradation of the performance.

Although antenna element 12 in the description above is fixed to core 11 by calking, it is not limited thereto; antenna element 12 can be formed by insert molding. In this case, soldering joint piece (not shown), which is separated from antenna element 12, is embedded with core 11 so as to serve a joint section between antenna element 12 and core 11.

Core 11 of antenna 13 and notch 14 of wiring board 14 are so designed that core 11 can be force-fitted into notch 14. Although still in a temporary assembly, antenna 13 and wiring board 14 can be kept in a stable condition until being soldered together. Such stableness provides wiring board 14 with an easy handling during transportation.

Figure 8:
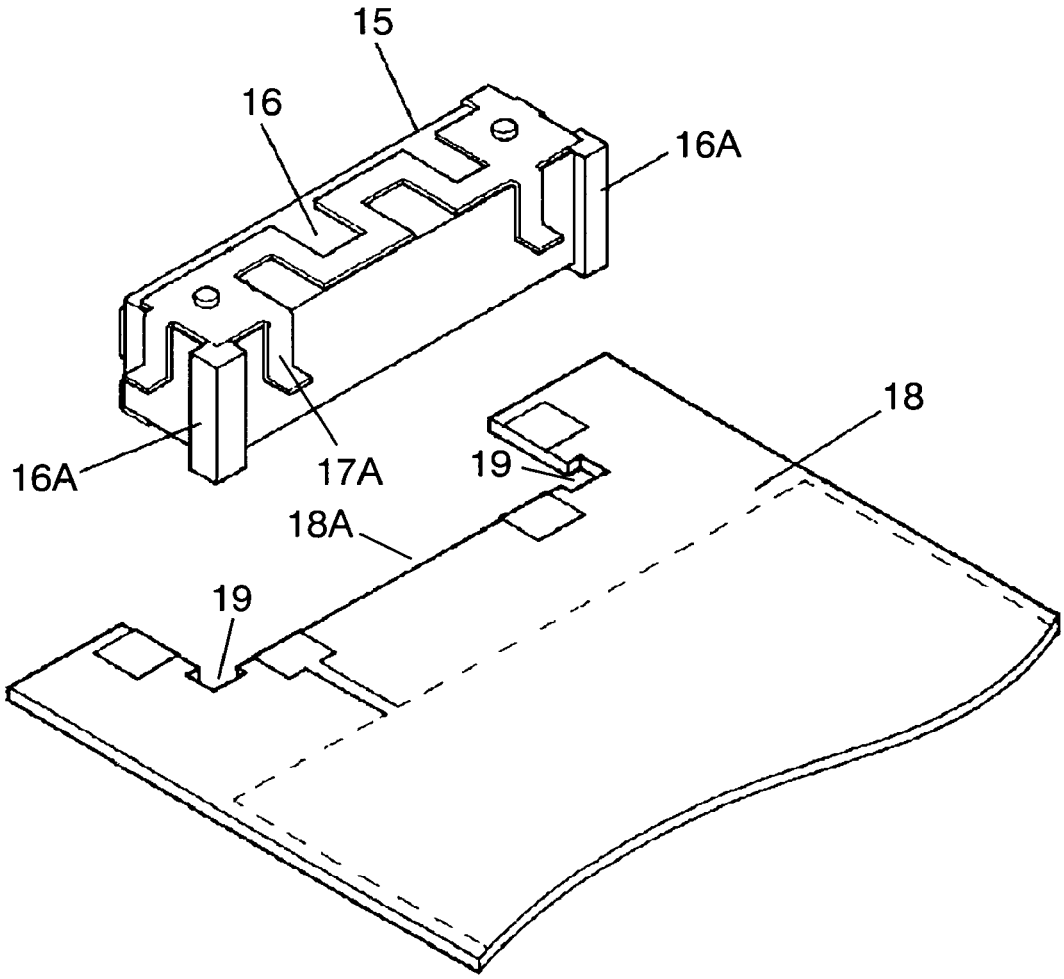
FIG. 8 is a perspective view illustrating how to mount an antenna having another structure on a wiring board.

According to the structure shown in FIG. 8, core 16 of antenna 15, which is generally shaped into a rectangular parallelepiped, contains small projections 16A. Projections 16A are formed each at both corners of the lengthwise surface on which feeding terminal 17A is disposed. Core 16 is attached to wiring board 18, with small projections 16A downwardly extended. On the other hand, wiring board 18 contains two corner-notches 19 at the inside corners of notch 18 so as to correspond to small projections 16A.

With such a structure, when core 16 of antenna 15 is fitted into notch 18A of wiring board 18, small projections 16A downwardly extend through corner-notches 19. Caulking by crashing small projections 16A allows antenna 15 to be temporarily but stably fixed to wiring board 18, thereby providing more stable attachment between the antenna and the wiring board until being soldered each other.

Such stableness can protect antenna 15 from coming apart from wiring board 18 even if the wiring board is turned upside down: efficiencies in mounting work is greatly improved.

Although small projections 16A are positioned each at both corners of the lengthwise surface of core 16 in FIG. 8, the positioning is not limited by the shape or the location of core 16; small projections 16A can be disposed at anywhere as long as the positioning is effective in caulking until antenna 15 is soldered to wiring board 18.

Figure 9:
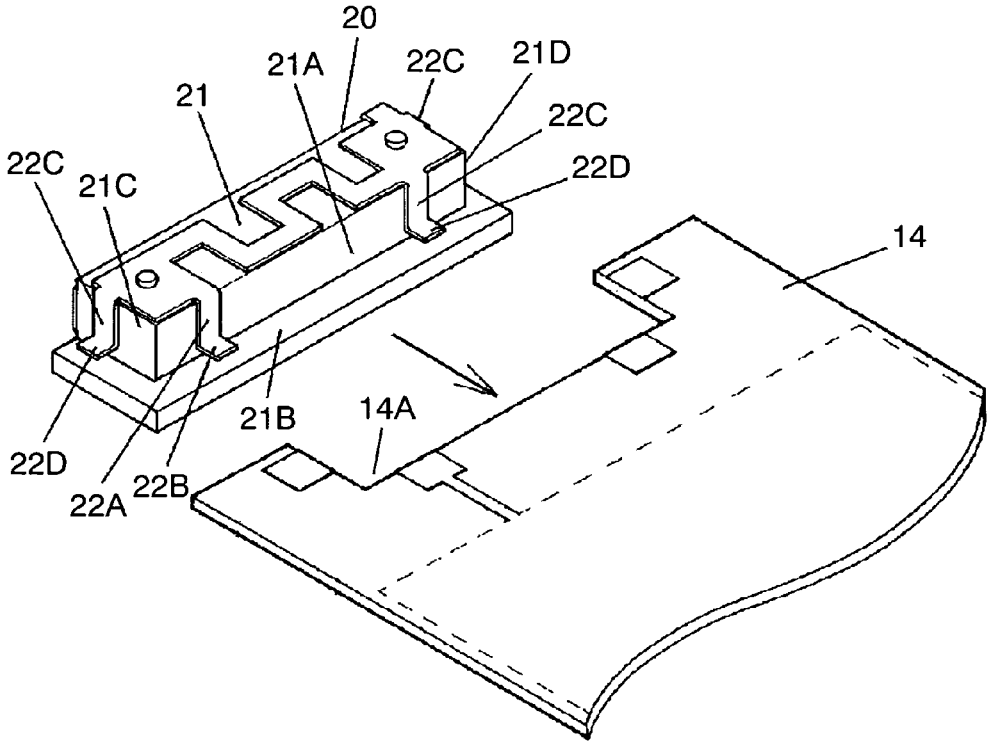
FIG. 9 is a perspective view illustrating how to mount an antenna having still another structure on a wiring board.
Figure 10:
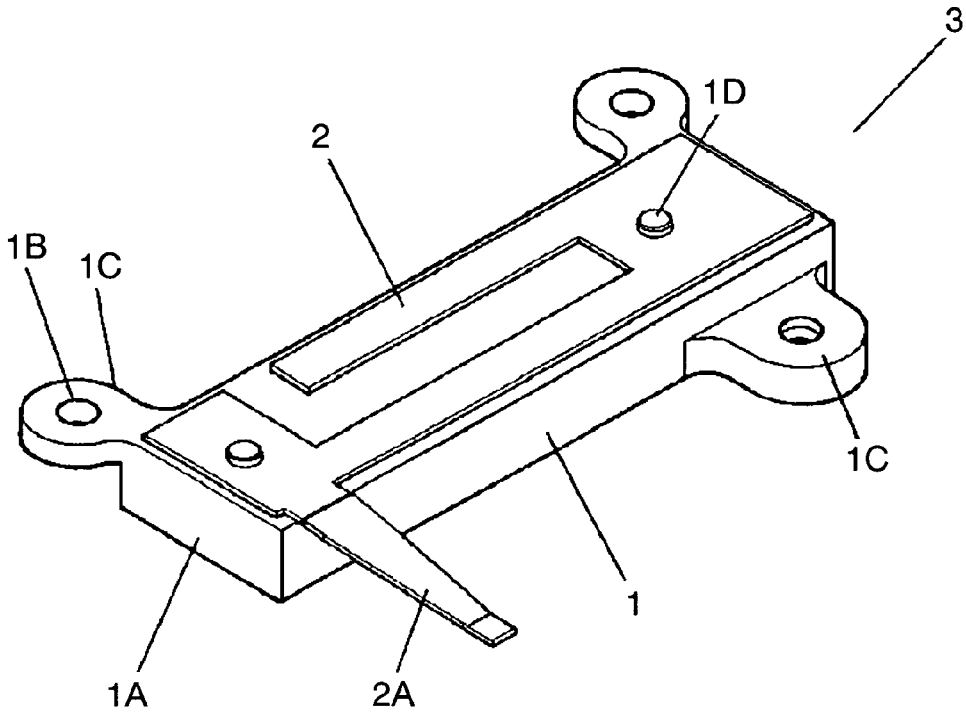
FIG. 10 is a perspective view showing the appearance of a prior-art antenna.
Figure 11:
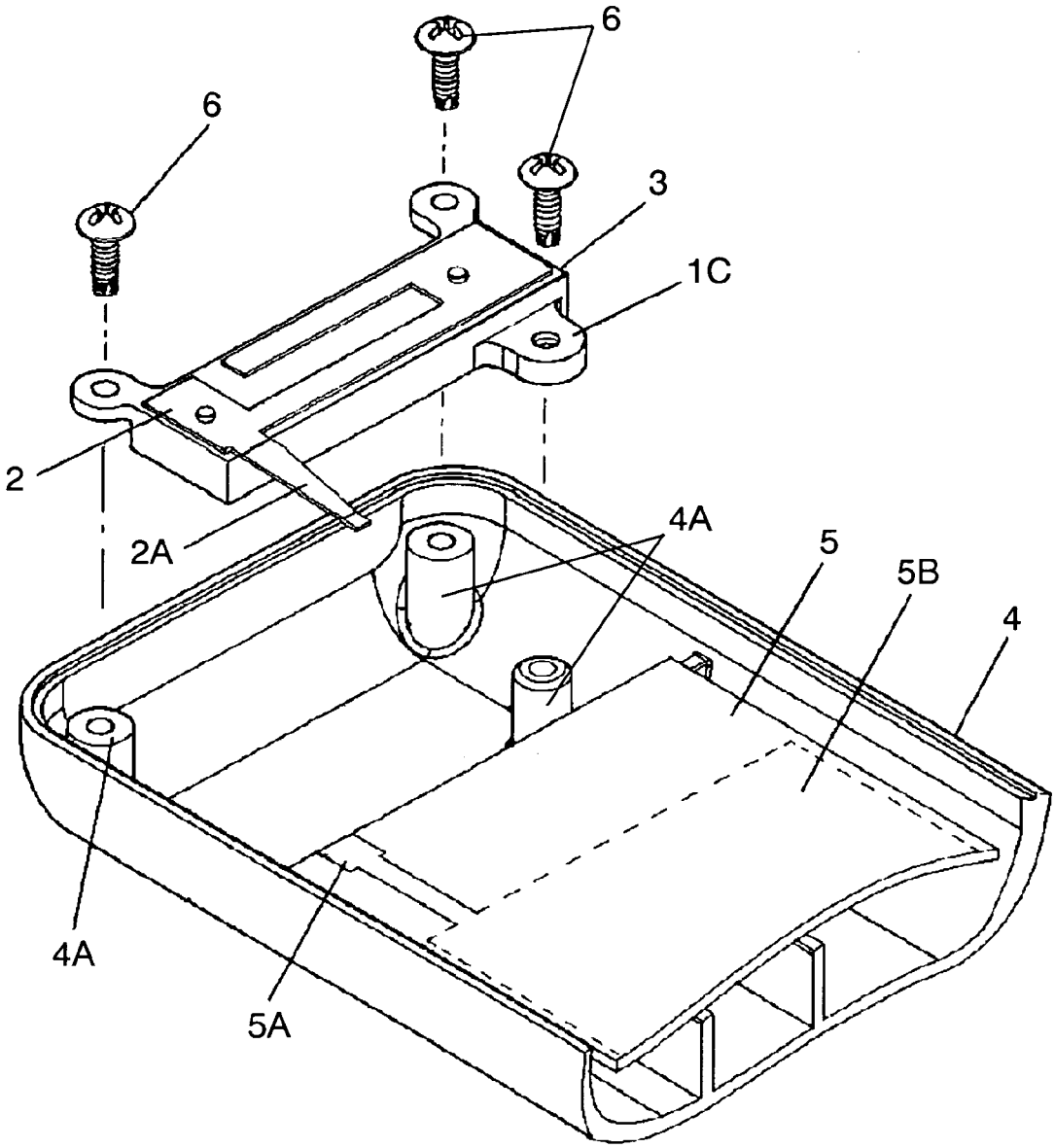
FIG. 11 illustrates how to mount the prior-art antenna on a wireless device.

According to the structure shown in FIG. 9, antenna 20 contains core 21 generally formed into a rectangular parallelepiped. Mounted on a principal plane of pedestal 21B, core 21 contains side surfaces 21A, 21C, and 21D. Surface 21A contains feeding terminal 22A and joint section 22C. On the other hand, surfaces 21C and 21D contains respective joint section 22C. Feeding terminal 22A and each joint section 22C extend toward the principal plane of pedestal 22B but have no contact with the plane; feeding terminal 22A and each joint section 22 are bent, at a distance (indicated by t0 in FIG. 9) from the principal plane, into an L-shape to form tip 22B and tip 22D, respectively. That is, Tips 22B and 22D face the principal plane of pedestal 21B, keeping gap to therebetween.

On the other hand, wiring board 14 is so designed that its thickness t1 is slightly larger than the gap t0. Antenna 20 is moved in the direction indicated by arrow Q and fitted into notch 14A of wiring board 14. The dimensional setting of t1>t0 allows the gap t0 to bite the thickness t1, thereby antenna 20 can be firmly attached to wiring board 14. If wiring board 14 and antenna 20 in the temporary assembly (i.e., before soldering) is moved, the firm connection can protect antenna 20 from coming off or having a wrong position.

To complete the mounting, tip 22B of feeding terminal 22A is soldered to feeding section 14. Similarly, tips 22D of joint sections 22C are soldered to corresponding fixed land 14.

The antenna of the present invention, as described above, is tightly fitted into the notch of the wiring board and then secured to the wiring board by soldering at the feeding terminal and the joint sections. The antenna can be mounted onto the wiring board with ease, i.e., the efficiency of mounting procedures is improved. Besides, the steady mounting condition ensures electrical connection with reliability and mechanical strength against impact load from the outside. It will be understood that the antenna of the present invention has a great value in industrial use.

What is claimed is:

1. An antenna comprising:

a rod-like core section made of insulating resin; and an antenna element with a feeding terminal, which is securely fixed with the core section, wherein the core section is fitted into a notch formed in a wiring board of a wireless device, the feeding terminal is soldered to the wiring board of the wireless device to complete mounting.

2. The antenna as defined in claim 1, wherein the core section is generally formed into a rectangular parallelepiped, and a joint section for soldering is deposed on side surfaces of the core section other than a side on which the feeding terminal of the antenna element is provided.

3. The antenna as defined in claim 2, wherein the feeding terminal and the joint section are located substantially at a midpoint of a side surface of the core section in a direction of height.

4. The antenna as defined in claim 1, wherein the core section is force-fitted into the notch of the wiring board.

5. The antenna as defined in claim 1, wherein the core section contains projections that downwardly extends under the wiring board on which the antenna is mounted.

6. The antenna as defined in claim 1, wherein the core section contains a pedestal under the side surface on which the feeding terminal is disposed, and a gap between the tip of the feeding terminal and the upper surface of the pedestal is determined so as to be slightly smaller than a thickness of the wiring board.

* * * * *